US007849663B2

(12) United States Patent
Goodrich

(10) Patent No.: US 7,849,663 B2
(45) Date of Patent: Dec. 14, 2010

(54) CORRUGATED SHIPPING CONTAINER SYSTEM

(76) Inventor: David Goodrich, 14 ox Hill Rd., Newton, CT (US) 06470

( * ) Notice: Subject to any disclaimer, the term of this patent is extended or adjusted under 35 U.S.C. 154(b) by 0 days.

(21) Appl. No.: 12/364,737

(22) Filed: Feb. 3, 2009

(65) Prior Publication Data

US 2009/0199514 A1 Aug. 13, 2009

Related U.S. Application Data

(62) Division of application No. 10/979,138, filed on Nov. 3, 2004, now Pat. No. 7,484,623.

(60) Provisional application No. 60/516,700, filed on Nov. 3, 2003.

(51) Int. Cl.
*B65B 43/08* (2006.01)

(52) U.S. Cl. ..... 53/456; 53/457; 206/600; 220/1.5; 229/117.05

(58) Field of Classification Search ..... 53/458, 53/456, 457; 206/386, 600; 220/1.5; 229/117.05
See application file for complete search history.

(56) References Cited

U.S. PATENT DOCUMENTS 2,534,010 A * 12/1950 Frye ..... 206/600
3,696,988 A * 10/1972 Nederveld ..... 206/386
4,019,634 A 4/1977 Bonnot
4,411,373 A 10/1983 Kupersmit
4,454,946 A * 6/1984 Yokowo ..... 206/600
4,693,411 A 9/1987 Snyder
5,105,946 A 4/1992 McDowell
5,170,933 A 12/1992 Perry
5,215,248 A * 6/1993 Moser ..... 229/122.21
5,794,542 A 8/1998 Besaw
5,934,474 A 8/1999 Renninger et al.
6,050,410 A * 4/2000 Quirion ..... 206/386
6,470,649 B2 10/2002 Usui et al.
6,581,759 B1 6/2003 Kalm
7,484,623 B2 * 2/2009 Goodrich ..... 206/600
2005/0150812 A1 7/2005 Carter

* cited by examiner

*Primary Examiner*—Thanh K Truong
(74) *Attorney, Agent, or Firm*—Sheldon H. Parker

(57) ABSTRACT

The present invention provides a cargo shipping crate having a base, four sides and a top cap, a first panel and a second panel. The first panel and the second panel form four sides of the crate. Each panel has a first, a second and a third subpanel. The first subpanel of the first panel is positioned to overlap the third subpanel of the second panel, and the second subpanel of the first and the second panel have substantially identical dimensions. The first subpanel of the first and the second panel have substantially identical dimensions, and the third subpanel of the first and the second panel have substantially identical dimensions. The top cap has four flaps, each of the four flaps are rotatable to a position superjacent a subpanel.

16 Claims, 8 Drawing Sheets

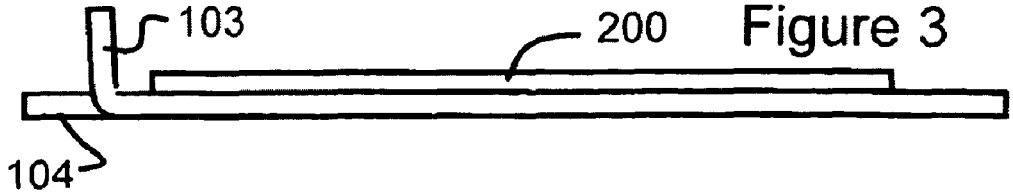
Figure 3
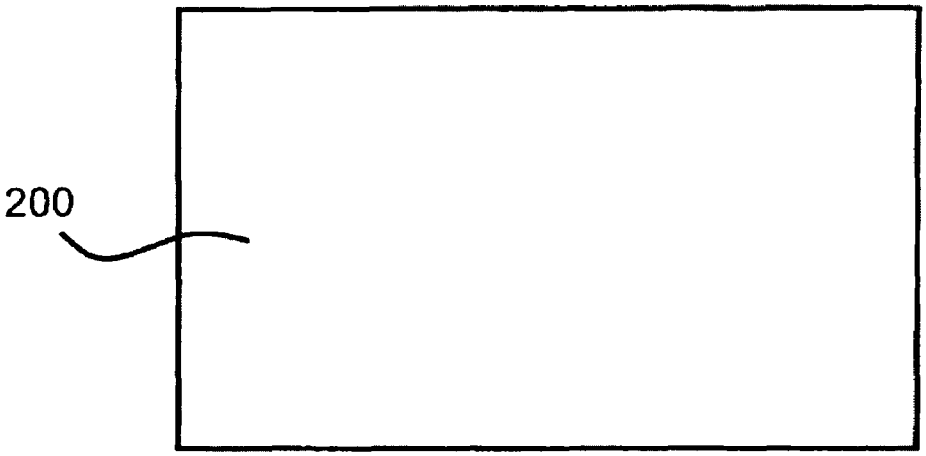
Figure 2
Figure 1
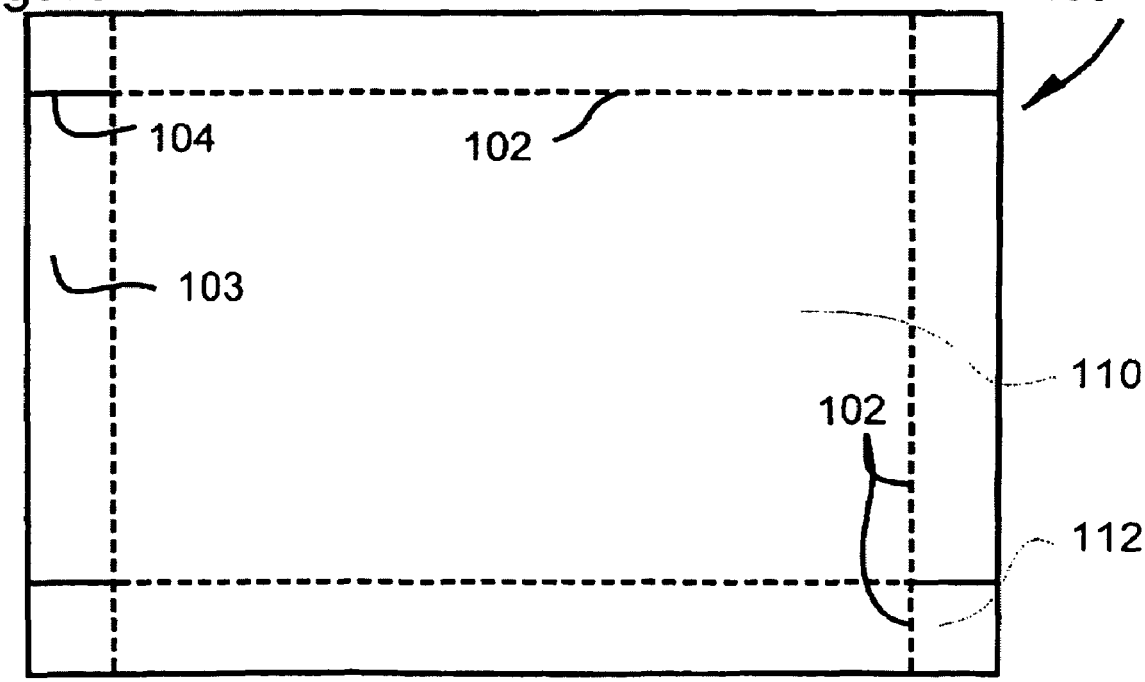

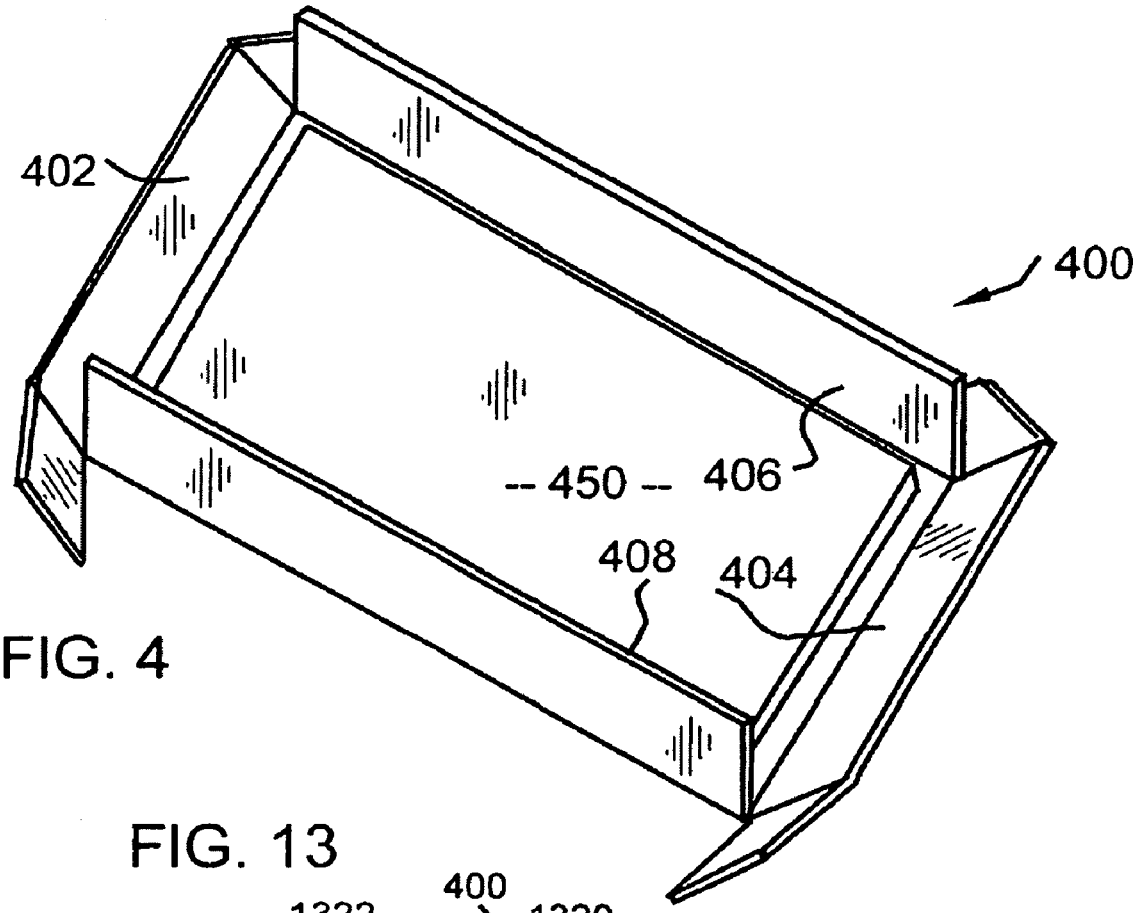
FIG. 4
FIG. 13
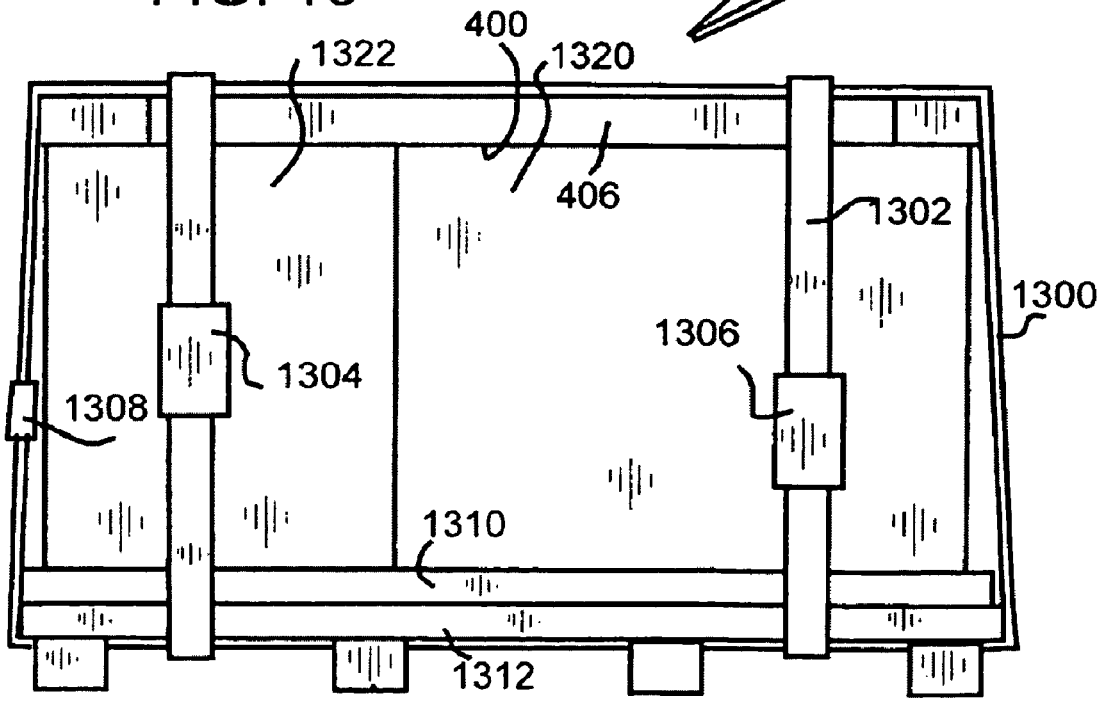

CORRUGATED SHIPPING CONTAINER SYSTEM

CROSS-REFERENCE TO RELATED APPLICATIONS

This application is a divisional of copending patent application Ser. No. 10/979,138 filed Nov. 3, 2004, which case claims the benefit of provisional patent application 60/516,700 filed Nov. 3, 2003, the disclosures of which are incorporated herein by reference.

GOVERNMENT INTEREST STATEMENT

NONE

BACKGROUND

1. Field of the Invention

The invention relates to a shipping container formed from sheets of corrugated material, such as paper, and to a system of delivering and assembling such containers.

2. Brief Description of the Prior Art

Long distance shipping crates, and particularly crates for international shipping of goods, are predominantly designed to provide an eight foot by eight foot by forty foot interior space. Crates having dimensions such that, in combination, they substantially fill the 8×8×40 ft. interior space, are employed to subdivide the interior space into subsections. The crates can be any combination of sizes that readily combine to produce an 8×8×40 foot combination. In those instances where the interior space of the cargo transporter is other than a standard 8×8×40 feet, then the crate can be dimensioned to correspond to the interior dimension of the cargo transporter. A cargo transporter is typically a metal shipping container.

Containers intended for intercontinental use have external nominal dimensions of:

| | |
|---|---|
| Length | 9.8125 feet (2.991 m), referred to as 10 feet;<br>19.875 feet (6.058 m), referred to as 20 feet;<br>29.9375 feet (9.125 m), referred to as 30 feet; and<br>(12.192 m), referred to as 40 feet. |
| Width | 8 feet (2.438 m) |
| Height | 8.5 feet (2.591 m), and<br>9.5 feet (2.896 m). |

The 20 feet and 40 feet containers are very popular in ocean freight. The 8.5 feet (8.5') high container is typically 8 feet 6 inches (8' 6") and is often referred to as the "standard container".

The demand for the high cube container is increasing. The popular high cube container has a normal height of 9.5 feet (9.5' or 9' 6").

There are "half height containers" (4.25' or 4' 3" high) designed for heavy loads such as steel rods and ingots, which absorb the weight limit in half the normal space The most widely used type of container is the general purpose (dry cargo) container having a nominal length and height of 20'×8.5', 40'×8.5', and 40'×9.5'. All above dimensions have permissible tolerances. The dimensions set forth above are not fixed, that is, the external and internal dimensions may vary among containers of the same specified length and height.

The container capacity is the total cubic volume (cube) a container can accommodate. The term cube refers to the cubic measurement of cargo. The capacity (i.e., the internal volume) is determined by multiplying the internal dimensions, that is, the product of internal length, width and height. The capacity may vary among containers of the same specified length and height.

SUMMARY

The present invention relates to a crate having a base, four sides, and a top cap. A first panel and a second panel form the four sides. Each of the two panels has a first, a second and a third subpanel. The first subpanel of the first panel is positioned to overlap, or overly the third panel of the second panel. The second subpanel of the first panel and the second subpanel of the second panel have substantially identical dimensions, the of the first panel and the first subpanel of the second panel have substantially identical dimensions, and the third subpanel of the first panel and the third subpanel of the second panel have substantially identical dimensions. Preferably, the first subpanel is less than one half the width of the third subpanel but at least twenty percent of the width of the third subpanel. Essentially, the first panel and the second panel are interchangeable.

The top cap has four flaps, each of the four flaps being rotatable to a position superjacent a subpanel.

The crate is formed of at least double wall corrugated paper, also called corrugated board. The base is preferably of double or triple wall corrugated material.

The upper and lower ends of the crate are enclosed with end caps, and the base panel of at least double wall corrugated paper is positioned on the lower end cap. The lower or bottom end cap is positioned on the skid. The base panel has peripheral dimensions that are substantially equal to the interior dimensions of the crate. Thus, the first and second panels are held between the base panel and the lower end cap.

The crate is used in combination with a skid for shipping cargo. The cargo can be a plurality of items that are individually packaged or wrapped with a cushioning material, or a combination thereof.

The skid has a planar support member, having an obverse side and a reverse side, and a plurality of feet secured to the planar support member reverse side. A bottom cap member is superjacent the planar support member obverse side and has a plurality of bottom cap flaps.

The base panel is positioned superjacent the bottom cap member. The first panel and a second panel, in combination, form the four sides of the crate. While more than two panels can be used, the use of only a pair of substantially identical panels is highly advantageous.

Each of the bottom cap flaps is superjacent a subpanel such that the first panel and the second panel are positioned between the bottom cap flaps and the base member. The base panel is at least double wall corrugated board and has peripheral dimensions that are substantially equal to the interior dimensions of the crate. Similarly, the top cap has a plurality of top cap flaps, each of the top cap flaps being superjacent a subpanel.

The means employed to secure the top cap to the first panel and the second panel, the bottom cap and the skid can be a plurality of ratcheted strapping bands.

Looking now to the method of assembling a crate and the packing of cargo into the crate, it is seen that the method of comprising the steps of:

a—mounting a base panel on a skid, b—positioning a first and a second panel member in contact with the periphery of the base panel, the first and the panel members being positioned in a plane perpendicular to the plane of the base panel, each of the panel members having a first, a second and a third subpanel, and wherein the first and third subpanels form a right angle with the second subpanel, c—positioning an end cap on the top of the first and the second panel member in a plane parallel to the plane of the base panel, the end cap having four lateral flaps, d—positioning at least two but less than all lateral flaps superjacent with a subpanel of a panel member and in a plane parallel to the plane of the subpanel to which it is superjacent, e—securing the end cap and the panel members to the skid by at least a first strapping band, f—maintaining at least one subpanel in a first position that is rotated greater than 90 degrees from a contiguous subpanel to provide an access opening to the crate, g—loading a plurality of items into the crate through the access opening, h—rotating the at least one subpanel to a second position that is at a right angle to the contiguous subpanel to close the access opening to the crate, i—positioning each of the less than all lateral flaps side by side with a subpanel of a panel member and in a plane parallel to the plane of the subpanel, j—securing the end cap and the panel members to the skid by at least a second strapping band, and k—wherein the crate is totally closed and secured to the skid.

Step (d) can further comprise positioning three lateral flaps superjacent with a subpanel of a panel member and in a plane parallel to the plane of the subpanel.

During the assembly of the crate, it is positioned on a bottom end cap, the bottom end cap being positioned on the skid and the base panel being positioned on the bottom end cap.

The bottom end cap has four lateral flaps, and at least two but less than all bottom end cap lateral flaps are positioned superjacent to a subpanel of a panel member and in a plane parallel to the plane of a subpanel, such that the at least one subpanel is free to rotate between a first position that is approximately in the plane of the base panel and a second position that is at a right angle to the base panel to close. This enables the first subpanel of the first panel and the third subpanel of the second panel to serve as doors. They can be rotated to the open position to provide access to the interior of the crate. When the crate is fully loaded with cargo, the two subpanels are rotated to the closed position and straps are wrapped around the crate to maintain the two subpanels in the sealed-closed position.

It is thus seen that the step of rotating at least one subpanel to a second position that is at a right angle to its contiguous subpanel closes the access opening to the crate.

The first strapping band is at a right angle to, and crosses over at least a second strapping band. Preferably a pair of strapping bands is used in each of the two directions.

Alternatively to the use of a bottom end cap, the plurality of subpanels is secured against the periphery of the base panel by a plurality of rail members.

BRIEF DESCRIPTION OF THE DRAWINGS

The invention will be described in conjunction with the accompanying drawings, in which:

FIG. 1 is a plan view of a top or bottom end cap;

FIG. 2 is a plan view of a base panel that is to be centrally positioned on a bottom end cap as illustrated in FIG. 1, in accordance with an embodiment of the present invention;

FIG. 3 is a side view of the base panel of FIG. 2 centrally positioned on the end cap of FIG. 1, and showing a lateral flap rotated to the vertical position.

FIG. 4 is a perspective view of a bottom cap.

FIG. 13 is a side view of an assembly crate mounted on a skid and held to the skid by ratchet straps or the like, as well known in the art. The bottoms of the side panels are held in place between the bottom panel and rails. The skid can be a pressed wood pallet of the type available from Litco International, Vienna, Ohio 4473-0150, or other skid as well known in the art.

DETAILED DESCRIPTION

Figure 5:
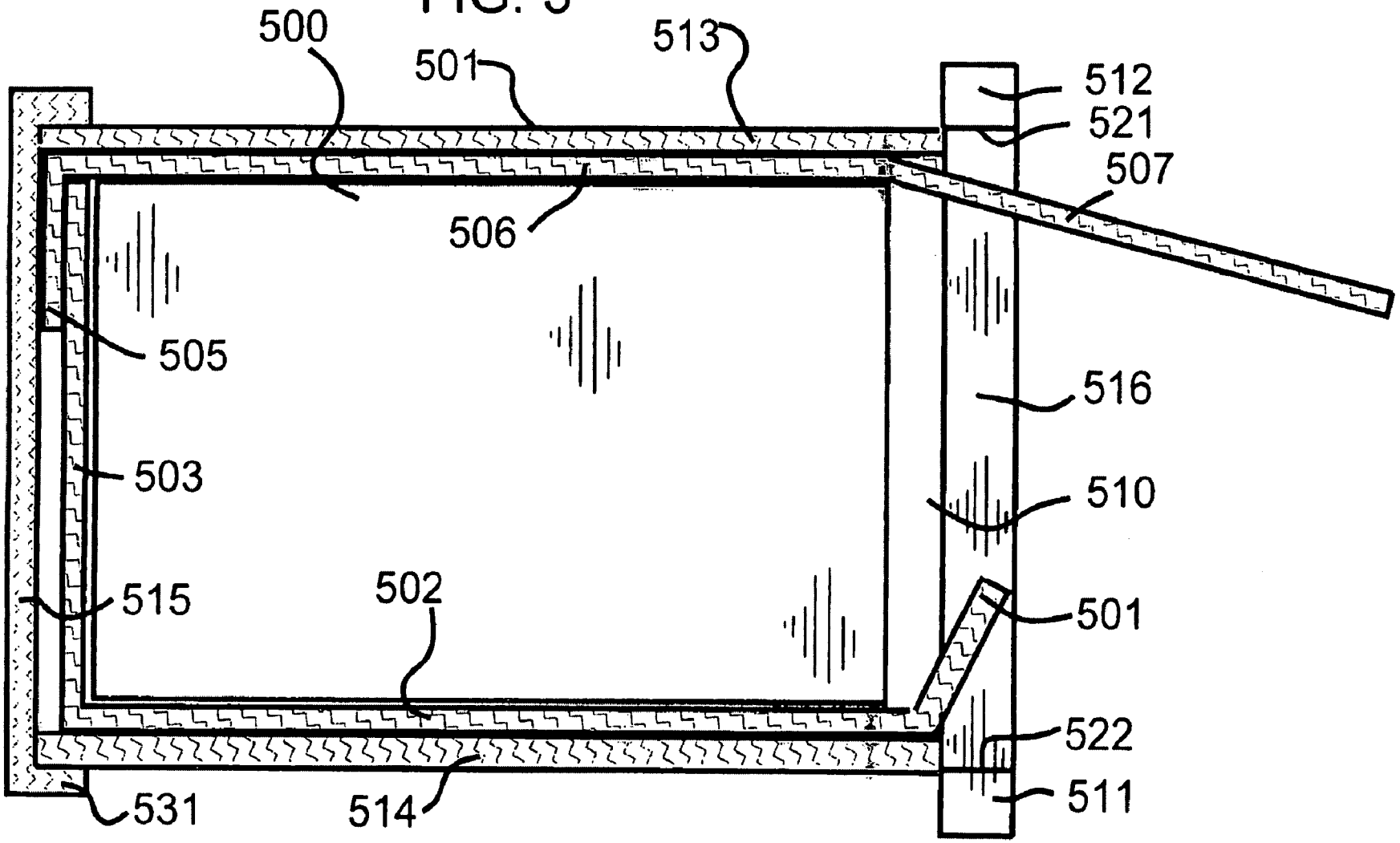
FIG. 5 is a top view of a crate assembly with two subpanels in the open position in accordance with an embodiment of the present invention.

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, the term "corrugate paper" and the term "corrugated board" are used interchangeably, and are inclusive of double wall and triple wall corrugated materials for shipping crates, as well known in the art.

For the purposes of the present invention, the term "crate" refers to an enclosure of any size or shape formed from a base an end cap and a pair of panels. Typically, the base is a second end cap. A crate formed from two end caps and two J panels, or two "U" panels.

For the purposes of the present invention, the term "overlap" refers to the side by side arrangement of a subpanel of a first panel with a subpanel of a second panel. The subpanel of the first panel generally is overlapped, that is, side by side, with a second panel's subpanel. The overlapping second panel's subpanel is generally about one third of the width of the first panel's overlapped subpanel. The term overlap is used interchangeably with the term "superjacent" meaning to lie over or upon, or overlying.

For the purposes of the present invention, the term "J" panel refers to a panel having three subpanels. A first subpanel is narrower than the other two panels. The base of the J forms the longer of the sidewalls of a crate. In a 2.5 feet by five feet crate, the base of the J is five feet wide and the third of the subpanels is thirty inches (approximately 76 cm.) wide. A pair of J panels form the four side walls of a crate, with the two end subpanels overlapped.

For the purposes of the present invention, the term "lateral flaps" when referring to caps, refers to a portion of the cap that extends in a plane perpendicular to the primary plane of the cap and thus provides a mechanism to engage and retain the side walls of a crate. A cap normally has four lateral flaps and each lateral flap has a pair of end flaps.

For the purposes of the present invention, the term "cap" refers to a covering that overlies the side walls of the crate and access to crate. Typically, a crate has a pair of end caps.

For the purposes of the present invention, the term "scored" when used with respect to corrugated panels, refers to an elongated crushing of the corrugated material to form a region about which subpanels can be folded to form a "U" or "J" shaped configuration.

For the purposes of the present invention, the term "means to secure said top cap to said first panel and said second panel, said bottom cap and said skid" refers to any device such as metal or plastic straps, tape or the like, as now know or may be developed in the future.

For the purposes of the present invention, the term "contiguous" refers to a member that has been constructed integrally with another member of a panel having multiple parts having various functions, where the multiple parts may not be separated from the remainder of the device without damaging the device. Contiguous subpanels are typically separated by score lines that provide a hinge like action.

For the purposes of the present invention, the term "double wall" refers to corrugated material that has two corrugated layers separated by a flat sheet and two outer flats sheets.

For the purposes of the present invention, the term "triple wall" refers to corrugated material that has three corrugated layers, with each layer being separated by a flat sheet and two outer flats sheets, thus providing four flat sheets and three corrugated sheets.

For the purposes of the present invention, the term "strapping bands" refers to straps of plastic, metal or the like, that is wrapped around a crate. The ends of each strap are locked or secured together. A ratchet mechanism can be used to secure the straps tautly around a crate.

For the purposes of the present invention, the term "skid" refers to a pallet or portable platform for loading or handling goods, or for storing or moving cargo or freight.

DESCRIPTION

The crates are typically made from wood and require being subjected to a sterilization process prior to being shipped internationally. It has now been found, that crates can be formed from corrugated board, either triple wall or double wall, instead of wood without sacrificing strength. The crate structure is designed for easy and speed of assembly into a finished crate, at the packing site, and for structural integrity. Unlike cardboard boxes, the shipping crate provides an access passage for ease of packing a single item or a plurality of items into the crate.

The invention also relates to a complete system of shipping flat corrugated panels, preferably on a skid, so as to provide the basis for forming a plurality of different sized crates, from a limited number of different sized corrugated panels.

The technology can also be applied, for example, to a half size crate, that is, a 4×4×7 ft. crate. It should be understood that the dimensions are not narrowly critical and are dependent upon the standards of the shipping industry. A 4×4×7 crate would actually be slightly under 4×4×7 so as to enable four such crates to be stacked side by side and over and under, within an eight by eight by eight area. Five such groupings would fill a forty foot long trailer.

The crate takes up only one skid and can be made from a corrugated sheet that wraps around the skid on three sides. The side dimensions, thus are 48"×48"×seven feet tall. An access door is provided and can be either a short U panel or a slide type, as more fully explained hereinafter.

It should be understood that certain terms are employed in a generic sense, and terms such as sheet, board and panel and used interchangeably, and other terms can equally describe the same structure. While triple layer corrugated paper is a preferred material, it is recognized that other materials can be used based on current technology and future improvements in technology. The corrugated plastic is not preferred because of ecological reasons, but from a structural standpoint, corrugated plastic and paper are equivalents. Recyclable plastics are preferred to plastics that are not readily recycled.

The crate fits on a single skid and is be made from a pair of corrugated sheets, each of which wraps around the skid on three sides. The sheets or panels are dimension such that they can fold flat and be transported on a skid. Thus, the design produces a folded structure, the maximum folded dimensions of which, are no greater than the dimensions of the skid.

In this embodiment, the pair of sheets overlap each other in order to optimize the strength of the crate. Preferably, each sheet is essentially "J" shaped, rather than "U" shape, that is, has a short side and a long side. The base between the two sides is preferably the long dimension of the skid. The long side is about equal to the ends of the skid. The ends of the skid are the two short regions of the rectangular skid. The short side of the corrugated sheet, or board, can be any where from slightly less than the dimension of the long side to a third of the long side dimension, or less.

In one embodiment of the invention, the base of the "J" is dimensioned relative to the long side of the rectangular skid and preferably is about 90 inches long, with a crease or score line or the equivalent, to enable the base to be folded into two 45 inch sections. The short side or leg of the J is about three feet and the long side is about four feet. When assembled, the three foot and four foot sections of the two J boards are overlapped, thus providing extreme structural strength.

In another embodiment, using a nominal 30 inch by 60 inch by 60 inch tall crate, the side panel walls are 30×60×10. The "J" units are reversed such that a 10 inch panel of one side wall unit overlaps a 30 inch panel of the other "J" unit. Preferably, the short panel is outside of the longer end panel. That is, in this example, a 10 inch panel of a first "J" unit, would overlie and be exterior of the thirty inch panel of the second "J" unit.

It is highly preferable that the two corrugated boards, or panels, are essentially identical. This provides an economy in the manufacture of the boards and ease in assembling the crate since there is minimal chance for error, since it is extremely obvious that an error has been made, if the two short sides and the two long sides over lap. Of great importance is the fact that the error is not fatal, since even when assembled incorrectly, the crate has great structural integrity.

The corrugated fiberboard can be of a lighter duty for either the short or long skid.

a. The corrugated material can be a lighter duty triplewall, i.e. 600TW or 750TW or 900TW or 1100TW or 1300TW. (The designation TW indicates triple wall, DW indicates double wall, QW indicates quadruple wall. The number indicates wall strength with higher number indicating higher strength material.)

b. The corrugated material can also be a double wall, i.e. 275DW, 350DW, 500DW, 750DW.

c. Parts of the skid can be made from double wall or light duty triplewall, as for example the skip top platform. Additionally, the doors or the ends of the crate can be double wall or light duty triple wall, as identified above.

The crate can be provided with a door section. The door can slide in place, running in a track formed by a pair of guide rails, or a guide rail and a triple wall or double wall flat bottom panel.

The 4×4×7 can fold on itself, in a Z form, such that it is in a compact, three layer format.

It should be understood that the discussion is predominantly directed to the dimensioning and designing of the panels that form the crate side walls. The skid, preferably in combination with a bottom panel forms the bottom of the crate and a top panel forms the top of the crate. The top panel has a large central section and four contiguous flaps. Each of the panels is rectangular and the central section can be square, as for example, in the case of a 4×4×4 cubic case.

The bottom panel is dimensioned based on the interior dimension of the crate and the top panel central section is dimensioned based on the exterior dimension of the crate. In another embodiment, interior rails are affixed to the bottom panel of the crate, with the outer dimensions of the rails being based on the interior dimensions of the crate. The bottom panel can be identical to the top panel, and provided with flaps, such that the crate has two end caps.

The pair of side panels, in combination has outer subpanels that have a width no greater than the width of the skid on which the crate is mounted. The skid width is W and length is L.

Each side panel has main panel section that has an equal to W. The term "equal to" is intended to encompass a dimension no greater than the width of the skid and preferably slightly less that the width W of the skid, to accommodate strapping dimensions, and exterior rails, if used.

At least one side forming panel, side 1, has at least one exterior subpanel having a width S1E1W1, no greater than skidW1. The second side forming panel S2 has a width W2 and can have an exterior side panel S2E1, having identical width S2E1W1 to that of S1E1W1. In the event that a third panel S3 is employed its width plus S1E2W1 and S2E2W1 form a side wall equal to crate long wall dimension CS3W or CS4W. If a sliding door arrangement is employed, the third or fourth panel can overlap one or both of the respective side panels.

Contiguous as employed herein is used to indicate sections or subpanels that sharing an edge or boundary; and are not merely touching but are connected typically by a score line or other fold facilitating break-line.

Adjacent, as employed herein, is used to indicate panels or subpanels that are close to, lying near, next to, adjoining another panel or subpanel, but not contiguous therewith. S1E2W1+S3W1+S2E2W1=CS3W, assuming no overlap of S3W1 with S1E2W1 and/or S2E2W1. Thus, where CS3W=8, S1E2W1+S3W1+S2E2W1 can combinations such as 4-0-4, 3-2-3, 2-4-2. In no case is any one of S1E2W1, S3W1, or S2E2W1 greater than CS3W.

It should be understood that in a preferred embodiment referred to a the "J" shape, an overlap is provided with the shorter leg of the overlap being exterior of the longer leg of the overlap regions. In the preferred embodiment, the shorter leg can be on the order of approximately one third of the length of the longer leg with which it is overlaps. Thus, a typical dimension can be 30×60×10 inches by 60 inches high. This design provides for an end doorway 30 inches wide.

The crate is a four-sided plane figure with four right angles, when viewed from the top. The structure formed has six sides, that is, is a hexahedron, with all corner having right angles. The structure can have rectangular top, bottom and end panels and square side panels, all square panels, or some other combination, as described herein.

In one embodiment, when viewed from the top, it is a square, preferably a 4×4×4×4 square, where the units are inches. Each vertical side panel is 4×7 feet. In another embodiment, it has two four foot sides and two seven foot sides. Two vertical panels are 4×7 and two are 7×7 feet.

The panels can be formed of subpanels. The dimensions are for the horizontal sides only, and in each case, the vertical height is seven feet. Thus, a 3+4+3 would be formed of a 3×7 panel, a 4×7 panel, and a 3×7 panel.

The designation 3+4+3 refers to a ten foot by seven foot panel having parallel score lines to form a 3×7 subpanel on each side of a 4×7 center, subpanel. Preferably, at least one of the score lines is double scored to permit folding in either direction, that is, to permit rotation about the score line 180 degrees clockwise and counterclockwise. The double score system forms a "living hinge" or "self-hinge".

In a 4×4×4×4 embodiment, at least two separate panels are employed. Preferably, the panels are identical, thus minimizing inventorying requirements.

The panels are preferably dimensioned to be folded to a dimension no greater than about 4×7. This is true for both the 4×7×4×7 rectangle and the 4×4×4×4 square configuration. The dimensions are approximate, and generally must be some what under the nominal size indicated, since two foot footer must fit into an eight foot width with some clearance space provided.

Preferred combinations are set forth below (all panels are 7 ft tall):

| | | |
|---|---|---|
| a) | 4 × 4 × 4 × 4 | 3 + 4 + 3 & 1 + 4 + 1 |
| b) | 4 × 4 × 4 × 4 | 4 + 4 + 4 & 4 |
| c) | 4 × 8 × 4 × 8 | 4 + 4 + 4 & 4 + 4 + 4 (with one 4 foot side panel on one or both panels serving as a swinging door.) |
| d) | 4 × 8 × 4 × 8 | 3 + 4 + 3 & 1 + 4 + 1 & 4 & 4 |
| e) | 4 × 8 × 4 × 8 | 2 + 4 + 2 & 2 + 4 + 2 & 4 & 4 |
| f) | 4 × 8 × 4 × 8 | 2.5 + 4 + 2.5 & 2.5 + 4 + 2.5 & 3 & 3 |
| g) | 4 × 8 × 4 × 8 | 4 + 4 + 1 & 1 + 4 + 4 & 3 & 3 |
| h) | 4 × 8 × 4 × 8 | 4 + 4 + 4 & 2 + 4 + 2 & 2 & 2 |
| i) | 4 × 8 × 4 × 8 | 4 + 4 + 4 & 1 + 4 + 1 & 3 & 3 |
| j) | 4 × 4 × 4 × 4 | 2 + 4 + 2 & 2 + 4 + 2 |

The more advantageous combinations are set forth below (all panels are 7 ft tall and employ "J" configuration with overlap):

| | | |
|---|---|---|
| a) | 4 × 8 × 4 × 8 | 1.3 + 8 + 4 & 1.3 + 8 + 4 |
| b) | 4 × 4 × 4 × 4 | 1.3 + 4 + 4 & 1.3 + 4 + 4 |
| c) | 2.3 × 5 × 2.3 × 5 | 2.3 × 5 × 0.8 & 2.3 × 5 × 0.8 |

The designation 4+4+4, for example, indicates a 12 foot panel having score lines at the 4 foot and 8 foot points, such that the side panel forming sections can fold in a "Z" form. The designation 2.3×5×0.8 indicates a panel that is about eight feet four inches long and having score lines at the 30 and 90 inch points.

It should be noted that the combinations such as (h, i, & j) for the 4×8×4×8 and (c) for the 4×4×4×4 use 4+4+4 panels. The selection of panel dimensions that can be used for different sized crates is preferred. The foregoing is representative examples only, and is not intended to be all inclusive. It should be understood that these are not exact dimensions, but rather, the exact dimensions must be adjusted to provide clearance between crates, space for skids, and space for strapping.

Crate System With Dimensions That provides for clearance between crates, space for skids, and space for strappings, are show below:

Crate Sizes

| | In feet | | | Size | | | |
|---|---|---|---|---|---|---|---|
| No. | Length | Width | Height | Description | Fits into | | Notes |
| 1 | 7.5 | 4.0 | 7.5 | Full-Crate | Shipper | na | 10 of these crates fit a commercial metal sea container |
| 2 | 3.8 | 4.0 | 7.5 | Half-crate | Shipper | na | 20 of these crates fit a commercial metal sea container. |
| 3 | 3.4 | 3.6 | 6.9 | Half-Packer | Packer 2 | | Packer crate fits inside Shipper crates |
| 4 | 3.4 | 3.6 | 3.4 | Qtr Packer | Packer "2, 4" | | |
| 5 | 1.7 | 3.6 | 3.4 | 8th Packer | Packer "2, 4" | | |
| 6 | 3.4 | 1.8 | 3.4 | 8th Packer | Packer "2, 4" | | |
| 7 | 1.7 | 3.6 | 1.7 | 16th Packer | Packer "2, 4" | | |
| 8 | 1.7 | 1.8 | 1.7 | 32nd Packer | Packer "2, 4" | | |
| Skid sizes | | | | Skids enable the crate to be lifted by a fork truck if necessary | | | |
| 1S | 3.8 | | | Length Skid | All | | made from Triplewall cut in half to fit all sizes |
| 2S | 3.6 | | | Width Skid | All | | |

The use of two and one half to three-foot openings are preferred for access to the crate. In the case of the 4×4×4×4 crate, one or two, two foot wide panels can be used in a swing door style. Preferably, the crate is provided with a pair of four foot by four foot by one foot, thus providing a four foot access and an overlap of panels.

A packaging system can comprise grouping a variety of panel sizes on a skid. As applied, for example, to a moving company, crates can be made on a job site to fit the needs of the project. The mover can select, for example, two 2+4×7 foot high panels to form a crate that is 4×4×7, or two 4+2×7 panels and two 4×7 panels to form a 4×8×7 crate. Thus, a stack of 4+2×7 and 4×7 panels can be used to produce at least two sizes of crates. A shipment of panels includes a skid with a variety of top panels, bottom panels and side panels to produce a multitude of sizes of crates. The panels are selected from the skid grouping and formed into a crate.

The panel dimensions are selected such that at least two panel units are employed to form a crate. At least one panel has two or three subpanels and no panel has more than three subpanels. That is, no panel can form more than three sides of the crate. In the case of a 4×8×7 feet high crate, two are used with two panels having three subpanels. The shortest of the three panels, serves as to flap to overlap the door that provide ease of access to the crate interior.

Looking now to the drawings, FIG. 1 shows an end cap 100 having score lines 102 that separate lateral flaps 103 from a central planar region 110. Corner flaps 112 are separated at one edge from an adjacent lateral by a cut line 104 and from the contiguous lateral flap by a score line 102.

A base panel 200 is positioned on the end cap 100 as shown in FIG. 3.

As illustrated in FIG. 4, an end cap is assembled by folding the lateral flaps 406, 404 and 402 to the perpendicular position relative to the plane of the base panel 450. The lateral flap 408 is shown in the perpendicular position. The corner flaps are similarly folded along a score line until they are superjacent to a lateral flap. The corner flaps can be secured to the lateral flaps by means of an adhesive, staples or the like, as well known in the art.

At least one lateral flap is left unsecured to corner flaps in order to permit the side panel or panel that are functioning as doors, to rotate about a score line, from an access open to a closed position. When the crate is fully loaded with cargo of any type, the unsecured corner flaps are sealed to a lateral flap. The structure, assembly and use is the same for the top end cap and the lower or bottom end cap.

FIG. 5 shows a crate viewed from the top, without a top end cap in place. The side walls are held in place by being secured between end cap lateral flaps and the base panel 500. The end cap 501 is shown with three lateral flaps 513, 515 and 514 superjacent a subpanel 506, 505 and 502 respectively.

The lateral flap 516 and its corner flaps 511 and 512 are coplanar with the base 510 of the end cap 501 and the base panel 500. Thus, the two subpanels 507 and 501 are free to rotate between the access open position as show in FIG. 5 and the access sealed position as illustrated by the subpanels 503 and 505. The top end cap, not shown, is in the same configuration as the bottom end cap 501.

When the filling of the crate is completed, and the subpanels 501 and 507 are in the closed position, the lateral flap 516 is rotated about a score line until it is superjacent the subpanel 501. Due to the action of the strapping bands, the lateral flap 516 will be superjacent to the subpanel 507. The same will hold true for the lateral flap 515 and the subpanel 503, as well as the corresponding top end cap lateral flaps.

The corner flaps 511 and 512 are rotated about their score lines 522 and 521 respectively. They are then sealed to their respective lateral flaps as shown, for example, in regard to corner flap 531.

Figure 6:
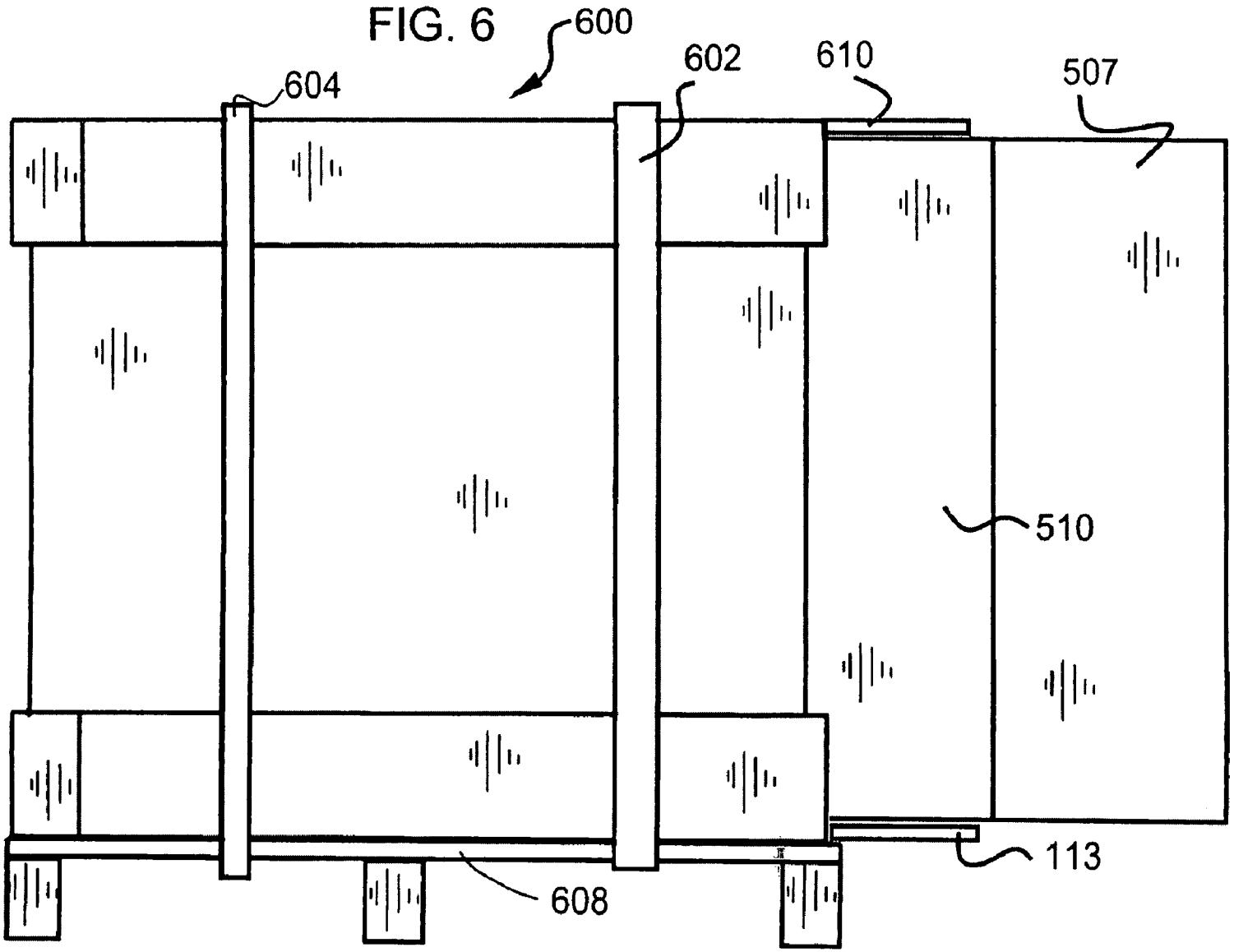
FIG. 6 is a side view of a crate assembly showing the top flap in place over the side panels, with three lateral flaps of the top and bottom end caps locking in place the side panels, such that two subpanels are rotatable about their score line, and showing a supporting skid in accordance with an embodiment of the present invention.

As illustrated in FIG. 6, an assembled crate as indicated general by reference arrow 600, has its top cap, side panels, bottom end cap and skid 608 secured together by a pair of strappings 602 and 604. The top cap lateral flap 610 and the bottom cap lateral flap 113, are left unsecured by straps and the subpanels 510 and 507 can be maintained in the open access position.

Figure 7:
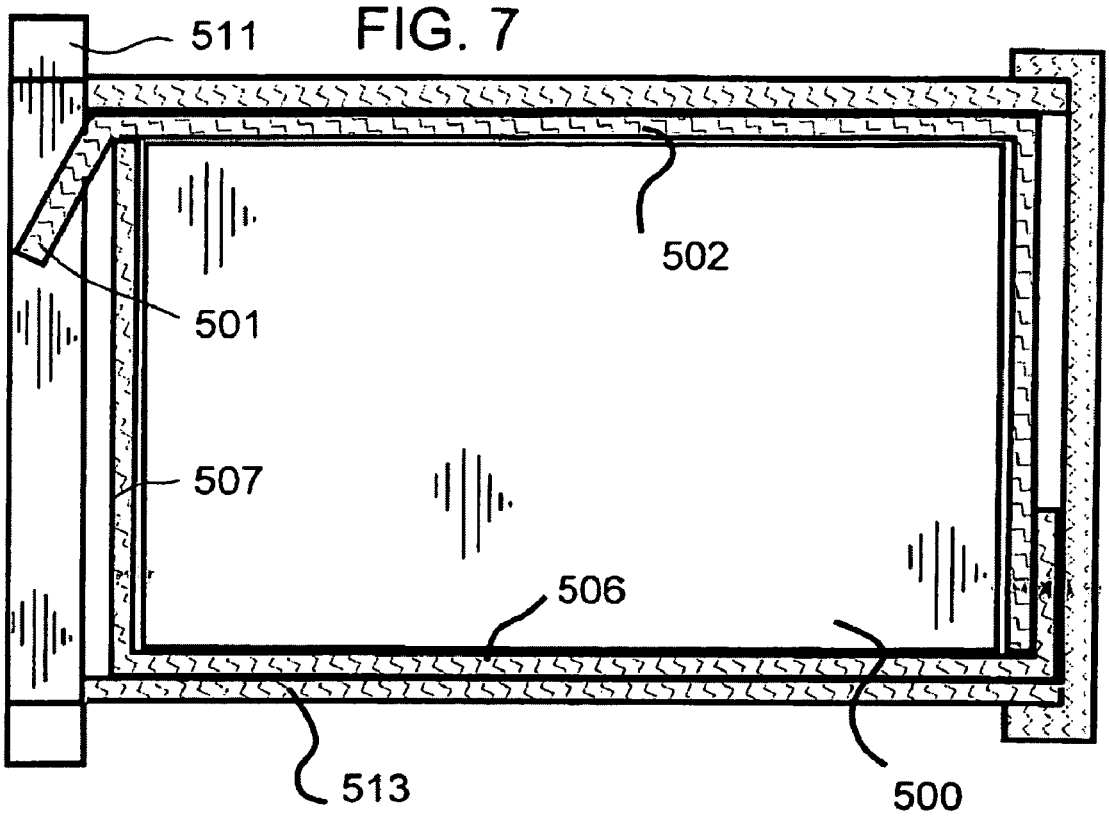
FIG. 7 shows a top view of side panels in a bottom cap with one lateral flap in the open position, in accordance with an embodiment of the present invention.

FIG. 7 is a top view of a crate shown without its top cap. The subpanel 507 has been rotated to the access closed position, and the subpanel 501 is ready to be rotated to its position superjacent the subpanel 507.

Figure 8:
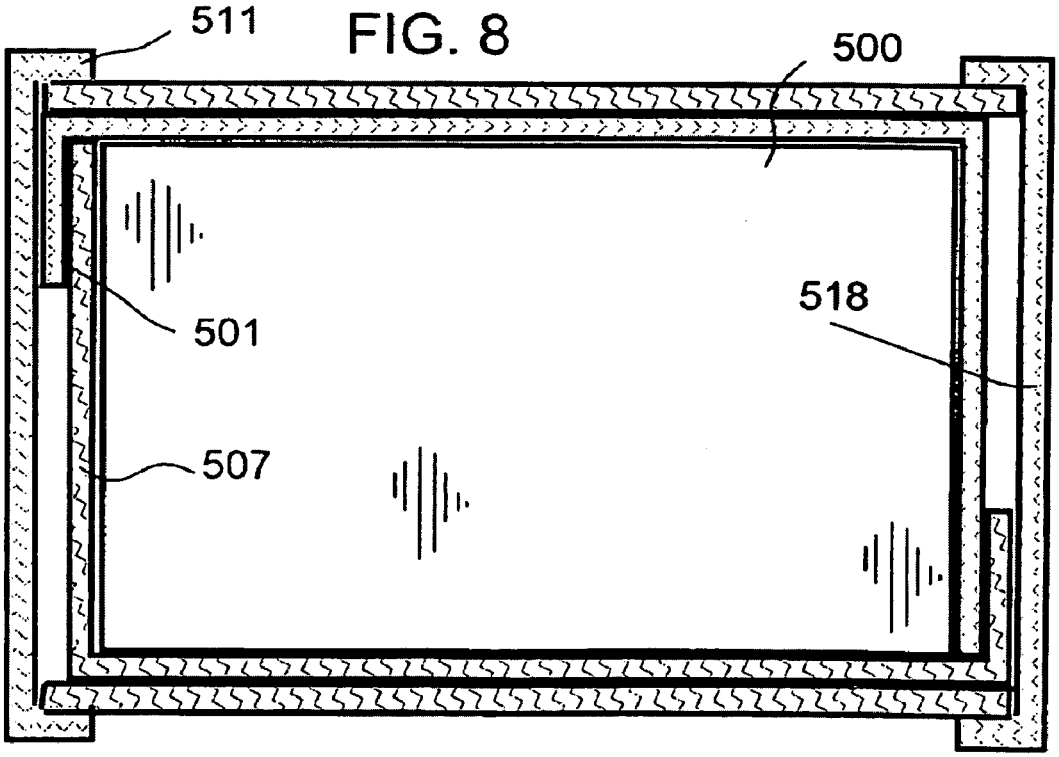
FIG. 8 is a top view of the embodiment of FIG. 7, showing all of the hinged door subpanels in the closed position, in accordance with an embodiment of the present invention.

FIG. 8 shows the next step in which the subpanel is superjacent the subpanel 507 and the corner flap 511 has been sealed to its respective lateral flap.

Figure 9:
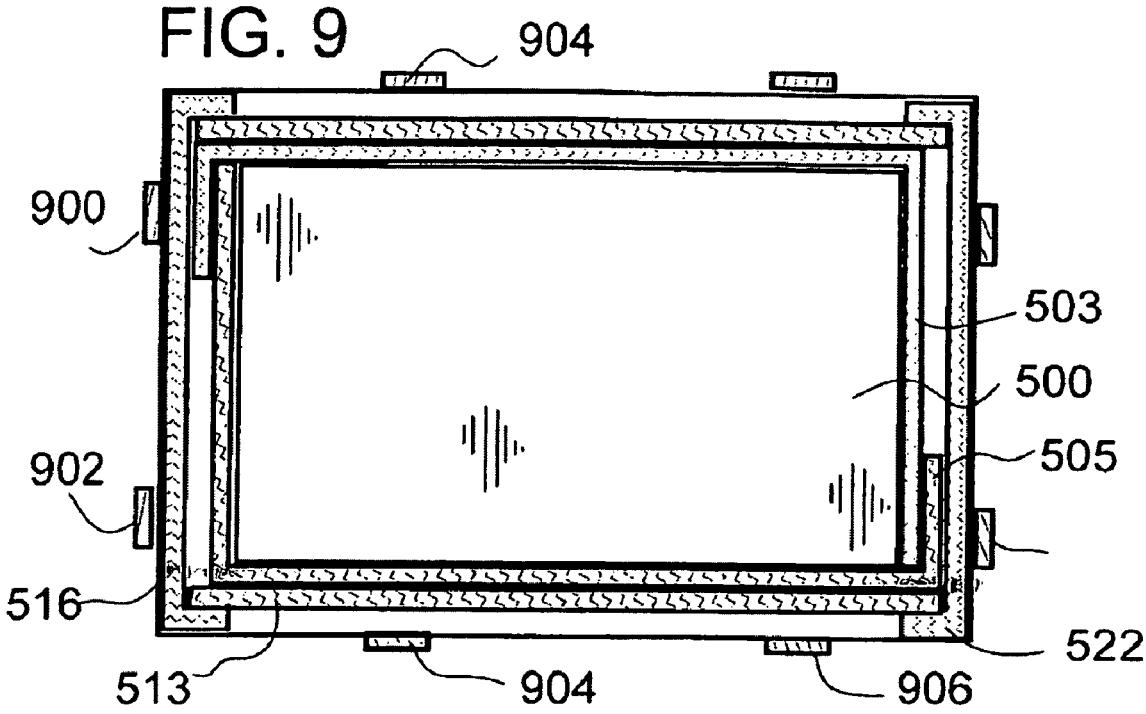
FIG. 9 is a cross-sectional view of a rectangular crate in accordance with an embodiment of the present invention.
Figure 10:
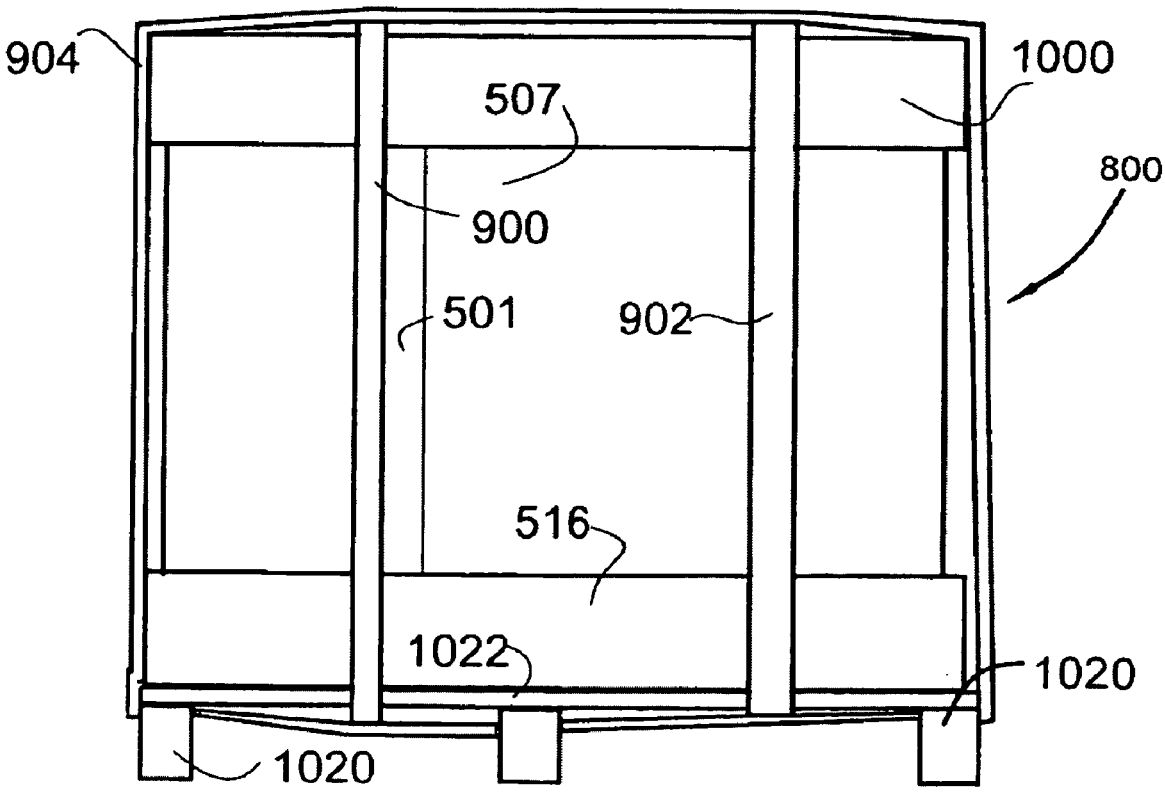
FIG. 10 is a side view of the crate of FIG. 9, in accordance with an embodiment of the present invention.

FIGS. 9 and 10 show the crate 800 in the final secures position. The pair of straps 904 and 906 overly and cross the pair of straps 900 and 902.

FIG. 10 further shows the top cap 1000 in place and shows the skid 1022 and its feet 1020 secured to the crate by the crossed strapping bands.

Figure 11:
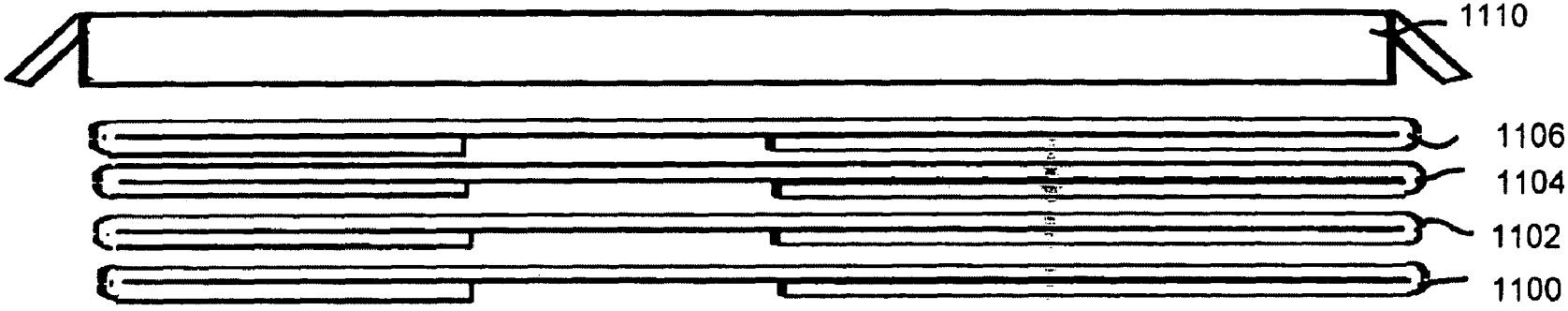
FIG. 11 is an exploded view of a stack of panel units and a top cap.

FIG. 11 an exploded view showing a plurality of panel with their outermost subpanels folded under the center panel and showing an end cap above the panels.

Figure 12:
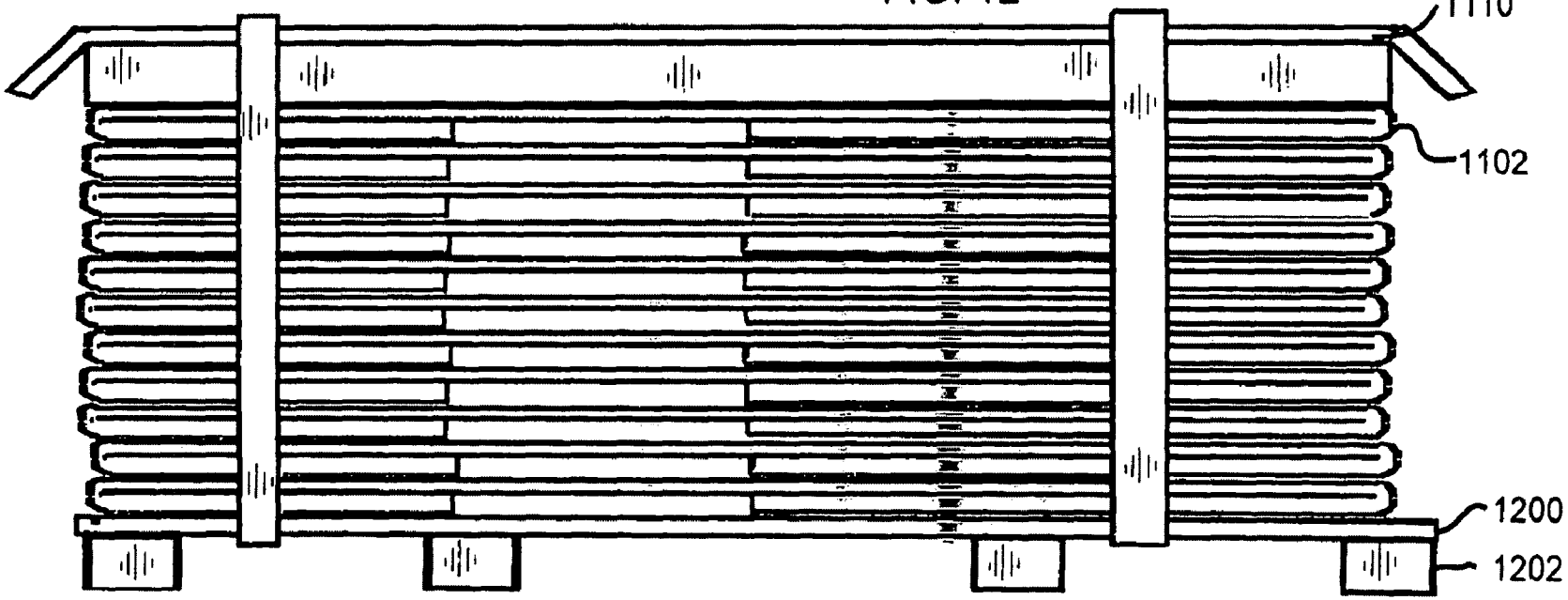
FIG. 12 is a side view of a stack of panel units on a skid, and topped off with a top cap in accordance with an embodiment of the present invention.

FIG. 12 shows a stack of panels on a skid 1200 and with an end cap 1110 overlying the uppermost panels. The stack can be strapped together with the straps passing between the feet 1202 of the skid 1200. The stack can be shipped, for example, to a freight moving company for use at a site in which cargo is to be loaded into crates and shipped to a distant location.

FIG. 13 shows an embodiment of the invention in which the wider side has a subpanel 1322 that overlies a subpanel 1320 of a second panel. In another embodiment of the invention, a rail 1310 is shown secured to a skid 1312. The panels are secured between the rails 1310 and the base panel within the crate. The top panel 400, the side panels and the skid are locked together by straps such as 13 and 1302. The two ends of each strap are ratcheted together locked together by clamps 1306, 1304 and 1308.

Figure 14:
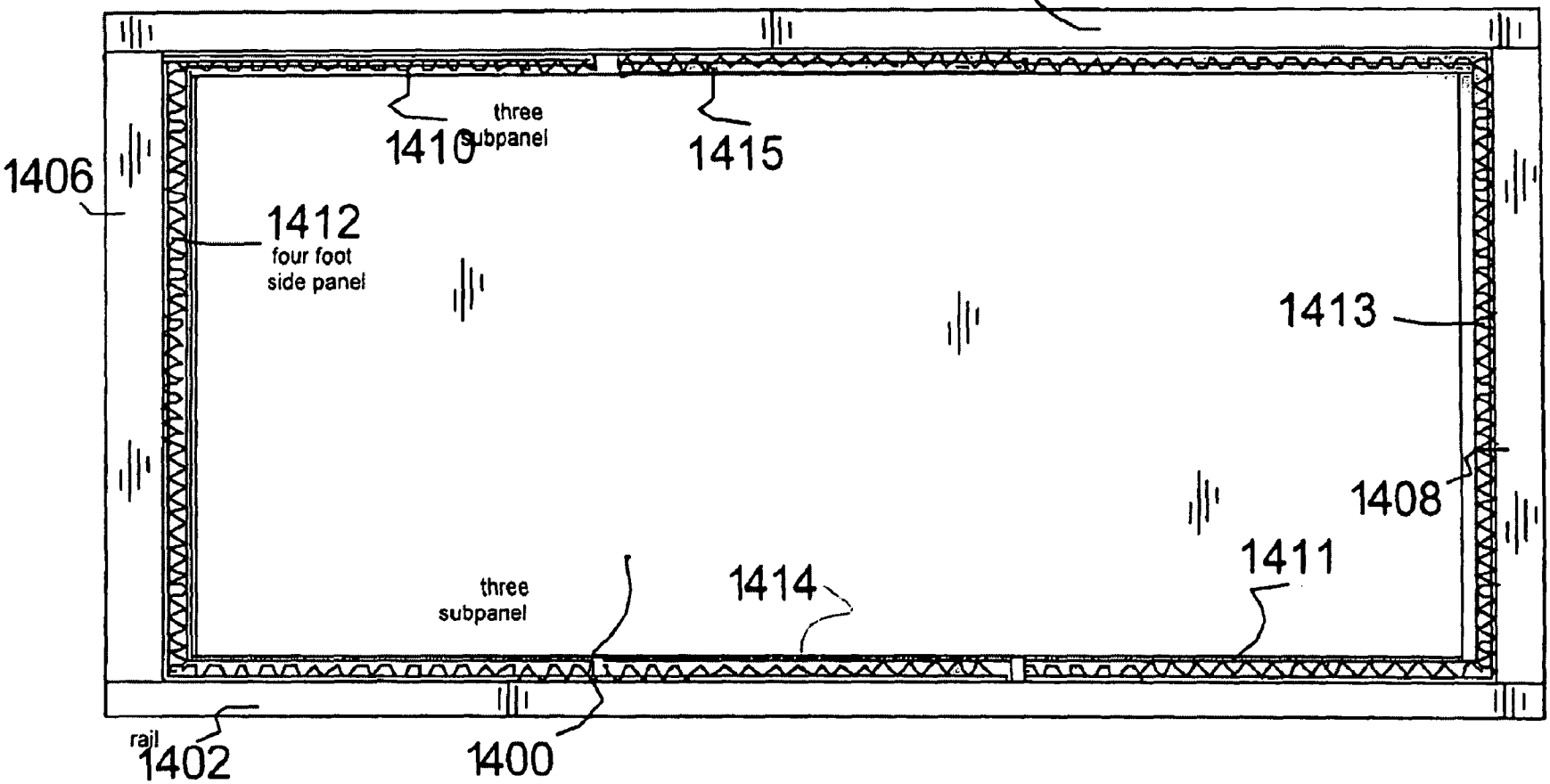
FIG. 14 is a plan view of a skid with rails and the bottom triple wall or double wall corrugated panel. The rails are spaced from the bottom panel by a distance that is equal to the thickness of the side panels in accordance with an embodiment of the invention.

FIG. 14 shows an alternate embodiment of the invention in which the panels are secured in place by rails 1402, 1406, 1404 and 1408 that are nailed, staples, or otherwise secured to the planar surface of the skid. The skid is below the rails, panels and base panel 1400 and thus is not visible in FIG. 14.

The first panel includes three subpanels, 1410, 1412, and 1414 and the second panel similarly has three subpanels 1411, 1413, and 1415. It should be understood that the term "subpanels" refers to contiguous sections that are separated by score lines. Alternatively and preferably, the subpanels 1414 and 1415 are overlayed by the shorter subpanels 1411 and 1410 respectively. The shorter superjacent subpanel is most advantageously exterior of the longer subpanel. It should be further noted that most advantageously, the access is provided at the shorter end of the crate, thus providing greater structural stability.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart there from.

What is claimed is:

1. The method of assembling a crate having a planar base panel, and four side walls, each of said side walls having a first panel member and a second panel member, said first panel member and said second panel member; a top end cap and a bottom end cap, said top end cap and said bottom end cap having a plurality of lateral flaps, comprising the steps of:

a—positioning said first panel member and second panel member in contact with the periphery of said base panel, said first and said second panel members being positioned in a plane perpendicular to the plane of said base panel, each of said first panel member and said second panel member having a first subpanel, a second subpanel and a third subpanel, and wherein each of said first subpanel and third subpanels are positioned to form a right angle with said second subpanel, each of said first subpanels having a width at least slightly less than the width of each of said third subpanels, b—positioning said first subpanel of said first panel member exterior of, and overlying the third subpanel of said second panel member and said first subpanel of said second panel member exterior of, and overlying the third subpanel of said first panel member, c—positioning said first subpanel of said first panel between a first of said plurality of lateral flaps of said bottom end cap and said third subpanel of said second panel, d—positioning said first subpanel of said second panel between a second of said plurality of lateral flaps of said bottom end cap and said third subpanel of said first panel, said first subpanel of said first panel being releasably secured between said third subpanel of said second panel and said first of said plurality of lateral flaps of said bottom end cap, each of said third subpanel having a peripheral edge positioned at the intersection between a second subpanel and a first subpanel, such that the third subpanel of the first panel member is in an abutting relationship to said second subpanel of said second panel member, and such that the third subpanel of the second panel member is in an abutting relationship to said second subpanel of the first panel member and forming a crate having two opposing reinforced corners formed of two subpanels;

e—positioning said top end cap on the top of said first panel member and said second panel member in a plane parallel to the plane of said base panel, said top end cap having a plurality of lateral flaps, f—positioning at least two of said plurality of lateral flaps of said top end cap superjacent with and exterior to a subpanel of a panel member and in a plane parallel to the plane of the subpanel to which it is superjacent.

2. The method of claim 1, further comprising the step of said planar base panel being positioned within said bottom end cap and said bottom end cap being positioned on a skid, said bottom end cap having four lateral flaps, positioning at least two of said four lateral flaps of said bottom end cap superjacent to a subpanel of a panel member and in a plane parallel to the plane of said subpanel whereby said first subpanel of said first panel and said third subpanel of said second panel are held between an edge of said base panel and a lateral flap of said bottom end cap, and said first subpanel of said second panel and said third subpanel of said first panel are held between an edge of said base panel and a lateral flap of said bottom end cap.

3. The method of claim 2, further comprising rotating at least one of said four lateral flaps between a first position that is approximately in the plane of said planar base panel and a second position that is at a right angle to said planar base panel and overlying a first subpanel and securing said top end cap and said panel members to said skid by at least a first strapping member, securing said end cap and said panel members to said skid by at least a second strapping member, whereby said crate is totally closed and secured to said skid.

4. The method of claim 3, further comprising position said first strapping member at a right angle to, and crossing over at least said second strapping member.

5. The method of claim 1, further comprising the step positioning a second planar base panel within a second end cap, said second end cap having four lateral flaps, positioning each of said second end cap four lateral flaps superjacent with, and exterior to a subpanel of said second planar base panel and in a plane parallel to the plane of the subpanel to which it is superjacent, and securing each subpanel of each panel member between a second end cap lateral flap and a planar base panel peripheral edge.

6. The method of claim 1, further comprising the step positioning a second planar base panel within a top end cap, said top end cap having four lateral flaps, positioning each of said four lateral flaps of said top end cap superjacent with, and exterior to a subpanel of said second planar panel member and in a plane parallel to the plane of the subpanel to which it is superjacent, and releasably securing at least one subpanel of a panel member between a second end cap lateral and a planar base panel peripheral edge.

7. The method of claim 1, wherein said planar base panel is mounted on, and secured to a skid.

8. The method of assembling a crate having a planar base panel, and four side walls, said side walls comprising:

a first panel member and a second panel, said first panel member and said second panel forming said four side walls, each of said panel members having a first subpanel, a second subpanel and a third subpanel, each of said first subpanel having a width at least slightly less than the width of each of said third subpanel, comprising the steps of:

a—positioning said first panel member and second panel member in contact with, and perpendicular to the plane of said planar base panel, such that said first subpanel and said third subpanels form a right angle with said second subpanel, b—positioning said first subpanel of said first panel member exterior of, and overlying a third subpanel of said second panel member, and said first subpanel of said second panel exterior of, and overlying a third subpanel of said first panel member, c—positioning said first subpanel and said second subpanel of said first panel member against a peripheral edge of said planar base panel, positioning said first subpanel and said second subpanel of said second panel member against a peripheral edge of said planar base panel such that each third panel is between an edge of said base panel and a first subpanel, d—releasably securing the first subpanel of the first panel against the third subpanel of the second panel member and between a peripheral edge of said planar base panel and a flap of an end cap and releasably securing the first subpanel of the second panel member against the third subpanel of the first panel and between a peripheral edge of said planar base panel and a flap of an end cap, e—positioning a top end cap on the top of said first panel and said second panel member in a plane parallel to the plane of said planar base panel, said end cap having a plurality of lateral flaps, f—positioning at least two lateral flaps of said top end cap superjacent with and exterior to a subpanel of a panel member and in a plane parallel to the plane of the subpanel to which it is superjacent.

9. The method of claim 8, said first panel member and said second panel member having a plurality of parallel fold lines, said plurality of fold lines dividing said first panel member and said second panel member into a first subpanel, a second subpanel, and a third panel, said first panel member and said second panel member being folded flat, further comprising the steps of unfolding said first panel second subpanel two foldable subsections, unfolding said first panel member first subpanel, unfolding said second panel member first subpanel, unfolding said first panel member third subpanel, unfolding said second panel member third first subpanel, and proceeding with steps (a) through (f).

10. The method of claim 8, said first panel member and said second panel member having a plurality of parallel fold lines, said plurality of fold lines dividing said first panel member and said second panel member into a first subpanel, a second subpanel, and a third panel, and dividing said second subpanel into two foldable subsections, said first panel member and said second panel member being folded flat, stacking a plurality of folded flat first panel members and second panel members to form a grouping of first and second panel members, forming first and second panel members into a crate by unfolding said first panel second subpanel two foldable subsections, unfolding said second panel member second subpanel foldable subsections, unfolding said first panel member first subpanel, unfolding said second panel member first subpanel, unfolding said first panel member third subpanel, unfolding said second panel member third first subpanel, and proceeding with steps (a) through (f).

11. The method of claim 10, further comprising mounting said grouping of folded flat first and second panel members on a skid, and securing said grouping to said skid.

12. The method of claim 8, wherein said planar base panel is mounted on, and secured to a skid.

13. The method of assembling a crate having a planar base panel, and four side walls, said side walls comprising:

a first panel member and a second panel member, said first panel member and said second panel member forming said four side walls, and an end cap, said end cap having a plurality of lateral flaps, comprising the steps of:

a—positioning said first panel member and second panel member in contact with the periphery of said base panel, said first and said second panel members being positioned in a plane perpendicular to the plane of said base panel, each of said panel members having a first, a second and a third subpanel, and wherein said first and third subpanels are positioned to form a right angle with said second subpanel, said first subpanels having a width at least slightly less than the width of said third subpanels, b—positioning said first subpanel of said first panel member exterior of, and overlying the third subpanel of said second panel member and said first subpanel of said second panel member exterior of, and overlying the third subpanel of said first panel member, c—positioning said first subpanel of said first panel between a first of said plurality of lateral flaps of said end cap and said third subpanel of said second panel, d—positioning said first subpanel of said second panel between a second of said plurality of lateral flaps of said end cap and said third subpanel of said first panel, said first subpanel of said first panel being releasably secured between said third subpanel of said second panel and one of said end flaps of said end cap, e—positioning an end cap on the top of said first panel member and said second panel member in a plane parallel to the plane of said base panel, said end cap having a plurality of lateral flaps, f—positioning at least two lateral flaps superjacent with and exterior to a subpanel of a panel member and in a plane parallel to the plane of the subpanel to which it is superjacent, g—positioning said planar base panel on a skid, h—securing said end cap and said panel members to said skid by at least a first strapping member, i—maintaining at least one of said third subpanels in a first position that is rotated to a position that forms an angle greater than 90 degrees from a contiguous subpanel to provide an access opening to said crate, j—loading a plurality of items into said crate through said access opening, k—rotating said at least one of said third subpanels to a second position that is at a right angle to said contiguous subpanel to close said access opening to said crate, l—positioning each of said less than all lateral flaps side by side with a subpanel of a panel member and in a plane parallel to the plane of said subpanel, m—securing said end cap and said panel members to said skid by at least a second strapping member, whereby said crate is totally closed and secured to said skid.

14. The method of claim 13, wherein said step of rotating said at least one subpanel to a second position that is at a right angle to said contiguous subpanel to close said access opening to said crate, further comprises the step of overlying a subpanel of said first panel on a subpanel of said second subpanel, such that said subpanel of said first panel overlies at least twenty percent of said subpanel of said second panel.

15. The method of claim 14, wherein said first panel first subpanel has a width that is substantially less than the width of said third subpanel, and said second panel first subpanel, second subpanel and third subpanel have dimensions that are substantially equal to the dimensions of the first panel first subpanel, second subpanel and third subpanel, respectively, and comprising the step of overlying said first panel first subpanel on said second panel third subpanel and wherein said step of rotating said at least one subpanel to a second position that is at a right angle to said contiguous subpanel to close said access opening to said crate, and overlying a subpanel of said first panel on a subpanel of said second subpanel, such that said subpanel of said first panel overlies at least twenty percent of said subpanel of said second panel.

16. The method of claim 13 and wherein said second subpanels having a width that is at least equal to the width of said first subpanels.

* * * * *